US006179332B1

(12) United States Patent
Funkhouser

(10) Patent No.: US 6,179,332 B1
(45) Date of Patent: Jan. 30, 2001

(54) COPY SAFE BINDER

(76) Inventor: James D. Funkhouser, P.O. Box 322, Redkey, IN (US) 47373

( * ) Notice: Under 35 U.S.C. 154(b), the term of this patent shall be extended for 0 days.

(21) Appl. No.: 09/334,229

(22) Filed: Jun. 16, 1999

(51) Int. Cl.[7] ..... B42D 15/00

(52) U.S. Cl. ..... 281/21.1; 281/29; 281/15.1; 281/38; 281/28; 402/8; 402/60; 402/500; 402/502

(58) Field of Search ..... 281/21.1, 15.1, 281/29, 36, 37, 28; 402/8, 14, 18, 60–68, 500, 502; 412/6–8, 36, 33

(56) References Cited

U.S. PATENT DOCUMENTS

| | | | | |
|---|---|---|---|---|
| 999,285 | | 8/1911 | Williams . | |
| 1,032,380 | * | 7/1912 | Crowson | 402/64 |
| 1,293,807 | | 2/1919 | Krohmer . | |
| 1,819,937 | * | 8/1931 | William | 402/63 |
| 2,831,706 | * | 4/1958 | Miller | 412/6 |
| 3,251,260 | * | 5/1966 | Serdechny | 85/7 |
| 3,645,637 | | 2/1972 | Gustafson . | |
| 4,498,828 | | 2/1985 | Ackerman . | |
| 4,743,048 | | 5/1988 | Growswith, III . | |
| 4,887,925 | | 12/1989 | Groswith, III et al. . | |
| 5,087,077 | | 2/1992 | Vercillo . | |
| 5,601,312 | * | 2/1997 | Funkhouser | 281/21.1 |
| 5,674,021 | * | 10/1997 | Hutnick | 402/14 |
| 5,727,816 | * | 3/1998 | Ong | 281/29 |
| 6,010,157 | * | 1/2000 | Pierson et al. | 281/21.1 |
| 6,047,990 | * | 4/2000 | Mogelonsky | 281/29 |

* cited by examiner

*Primary Examiner*—Willmon Fridie, Jr.
(74) *Attorney, Agent, or Firm*—Arnold D. Litt

(57) ABSTRACT

A copy safe binder is disclosed. The binder includes a cover member including a coupling flap and a cover panel linked by a first fold line. The binder further includes a coupling member associated with the coupling flap for attaching loose sheets thereto. The cover panel is provided with a security strip secured to the cover panel adjacent to the fold line for preventing access to the coupling member for the removal of loose sheets from the binder without destroying a fully assembled binder.

15 Claims, 2 Drawing Sheets

14
34
42
20
22
46
40
18
38
32
16
36
12
12
38
42
10
40
14
20
44
46
36
22

COPY SAFE BINDER

BACKGROUND OF THE INVENTION

1. Field of the Invention

The invention relates to a binder for loose sheets of paper. More particularly, the invention relates to a binder designed to prevent the removal and unauthorized copying of bound documents.

2. Description of the Prior Art

Unauthorized copying of documents is a problem which costs those in the document preparation business great sums of money. For example, stenography services are often used to transcribe legal proceedings, for example, depositions, court room arguments, meetings, etc. In addition to charging for the service of simply transcribing the proceedings, stenography services are also in the business of providing transcripts of the transcribed proceedings. In fact, most stenography services retain the rights to the transcribed materials and require that the customer purchase additional copies from the service.

While such an arrangement allows the stenography services to make additional money, it also helps those involved with the legal proceeding to maintain the integrity of the voluminous records developed during a legal proceeding. Specifically, when copies of transcripts are purchased directly from the stenography service, these copies are certified as true and accurate recordings of the original proceedings. When these transcripts are unbound and copied, papers are often lost and the integrity of the file is destroyed.

Unfortunately, many individuals involved with legal proceedings simply order a single copy of the transcript, copy it, and retain the original copy for court submission purposes. As discussed above, this often leads to inaccuracies and lost integrity of the files relating to the legal action, as well as lost income to the service that created the transcript. The cost for recreating such files greatly surpasses the simple cost of maintaining an integrally bound transcript and purchasing additional copies from the stenography service.

As such, a need exists for a binding system which allows simple binding of loose papers while also ensuring the integrity of the transcript by preventing the unauthorized removal and copying of the bound transcript. The present invention provides such a binding system.

SUMMARY OF THE INVENTION

It is, therefore, an object of the present invention to provide a copy safe binder. The binder includes a cover member including a coupling flap and a cover panel linked by a first fold line. The binder further includes a coupling member associated with the coupling flap for attaching loose sheets thereto. The cover panel is provided with a security strip secured to the cover panel adjacent to the fold line for preventing access to the coupling member for the removal of loose sheets from the binder without destroying a fully assembled binder.

It is also an object of the present invention to provide a binder wherein the cover member is a rear cover member, the coupling flap is a rear coupling flap and the cover panel is a rear cover panel.

It is another object of the present invention to provide a binder including a front cover member having a front coupling flap and a front cover panel linked by a second fold line, wherein the coupling member binds loose sheets between the front cover member and the rear cover member.

It is a further object of the present invention to provide a binder wherein the coupling member includes a first coupling member associated with the front coupling flap and a second coupling member associated with the rear coupling flap.

It is also an object of the present invention to provide a binder wherein the first coupling member is at least one prong extending from the front coupling member and the second coupling member is at least one aperture formed in the rear coupling flap for receipt of the at least one prong. The at least one prong and the at least one aperture cooperate to secure loose sheets between the front cover member and the rear cover member.

It is another object of the present invention to provide a binder wherein the security strip is an adhesive strip adapted for attachment to the coupling flap for preventing access to the coupling member for the removal of loose sheets from the binder without destroying a fully assembled binder.

It is a further object of the present invention to provide a binder wherein the coupling member includes a first coupling member associated with the front coupling flap and a second coupling member associated with the rear coupling flap, and the adhesive strip secures the rear coupling flap to the rear cover panel for preventing access to the first coupling member for the removal of loose sheets from the binder without destroying a fully assembled binder.

It is still a further object of the present invention to provide a binder wherein the cover member, coupling flap and cover panel each include an interior surface and an exterior surface, and the adhesive strip is attached to the interior surface of the cover panel.

It is also an object of the present invention to provide a method for binding loose sheets within a binder. The method comprises the steps of binding loose sheets within the binder and bonding the cover panel to the coupling flap to prevent access to the coupling member for preventing the removal of loose sheets from the binder without destroying a fully assembled binder.

Other objects and advantages of the present invention will become apparent from the following detailed description when viewed in conjunction with the accompanying drawings, which set forth certain embodiments of the invention.

DESCRIPTION OF THE PREFERRED EMBODIMENT

Figure 1:
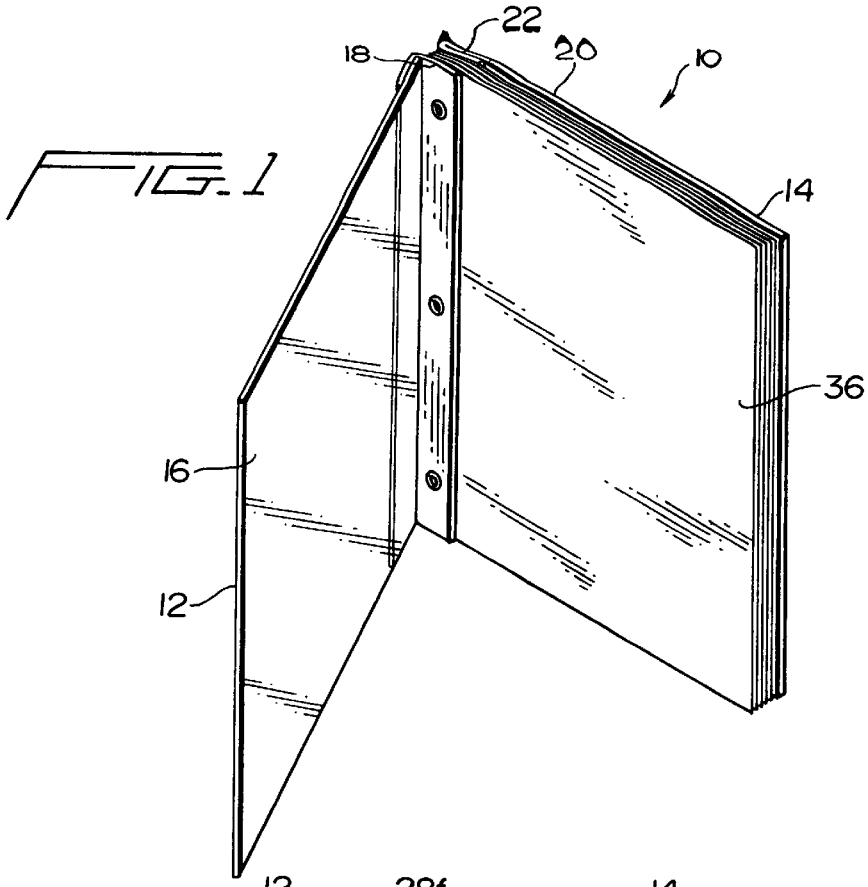
FIG. 1 is a perspective view of the assembled binder in accordance with the present invention.
Figure 4:
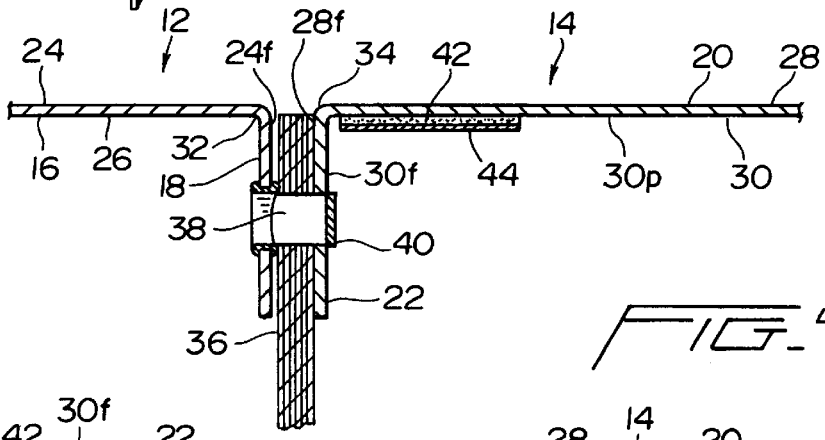
FIG. 4 is a cross sectional view of the binder partially assembled with the adhesive strip unattached.
Figure 5:
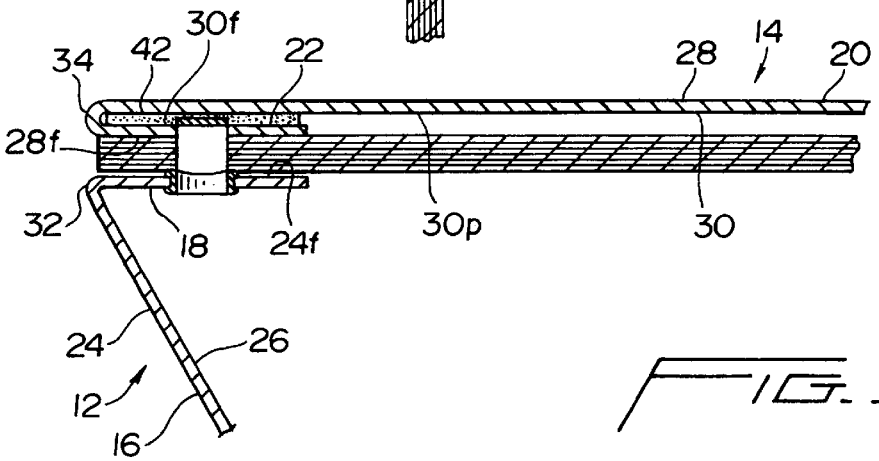
FIG. 5 is a cross sectional view of the fully assembled binder.

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 to 5, a copy safe binder 10 in accordance with the present invention is disclosed. The binder 10 is substantially similar to traditional prong/tab binding systems. As such, the binder 10 includes a front cover member 12 and a rear cover member 14. The front cover member 12 is provided with a front panel 16 and an integral front coupling flap 18. The rear cover member 14 is similar provided with a rear panel 20 and an integral rear coupling flap 22. For reasons that will be better appreciated from the following disclosure, the front and rear cover members 12, 14 are substantially the same size, although variations in their size and shape may be made without departing from the spirit of the present invention.

The front cover member 12 includes an exterior surface 24 and an interior surface 26. The rear cover member 14 also includes an exterior surface 28 and an interior surface 30. In practice, the front coupling flap 18 and the rear coupling flap 22 are folded along respective fold lines 32, 34 on the front and rear cover members 12, 14 such that their exterior surfaces **24*f*, 28*f* meet to form a standard binder in which loose sheets 36 may be placed. When the binder 10 is coupled in this manner, the front panel 16 and the rear panel 20 cover the bound loosed sheets 36, while the front coupling flap 18 and the rear coupling flap 22** bind the loose sheets within the binder.

With this in mind, the front coupling flap 18 is shaped and dimensioned for attachment with the rear coupling flap 22. The front coupling flap 18 includes a plurality of prongs 38 spaced for receipt within apertures 40 formed in the rear coupling flap 22. In accordance with the preferred embodiment of the present invention, the front coupling flap 18 is provided with three equally spaced prongs 38 and the rear coupling flap 22 is provided with three similarly spaced apertures 40. However, other binding arrangements may be employed without departing from the spirit of the present invention.

In use, the prongs 38 are passed through the apertures found in the loose sheets 36 to be bound. The exterior surface **24*f* of the front coupling flap 18 and the exterior surface 28*f* of the rear coupling flap 22 are then brought together with the loose sheets 36 therebetween. As the front coupling flap 18 and the rear coupling flap 22 are brought together, the prongs 38 of the front coupling flap 18 are passed through the apertures 40 in the rear coupling flap 22, and the exterior surfaces 24*f*, 28*f* of the front and rear coupling flaps 18, 22 are pushed together to secure the loose sheets 36 therebetween. Once the loose sheets 36 are properly aligned, the prongs 38 may be bent over to securely coupled the front coupling flap 18, and the front cover member 12, to the rear coupling flap 22, and the rear cover member 14 (see FIGS. 3 and 4**).

Prevention of the unauthorized removal and copying of the bound loose sheets is achieved by the inclusion of an adhesive strip 42, or security strip, on the rear cover member 14. A release strip 44 covers the adhesive strip 42 until it is desired to secure the interior surface **30*f* of the rear coupling flap 22 to the adhesive strip 42. When it is desired to seal the binder 10, the release strip 44 is removed and the adhesive strip 42 is brought in contact with rear coupling flap 22 (see FIG. 5**).

Figures 2, 3:
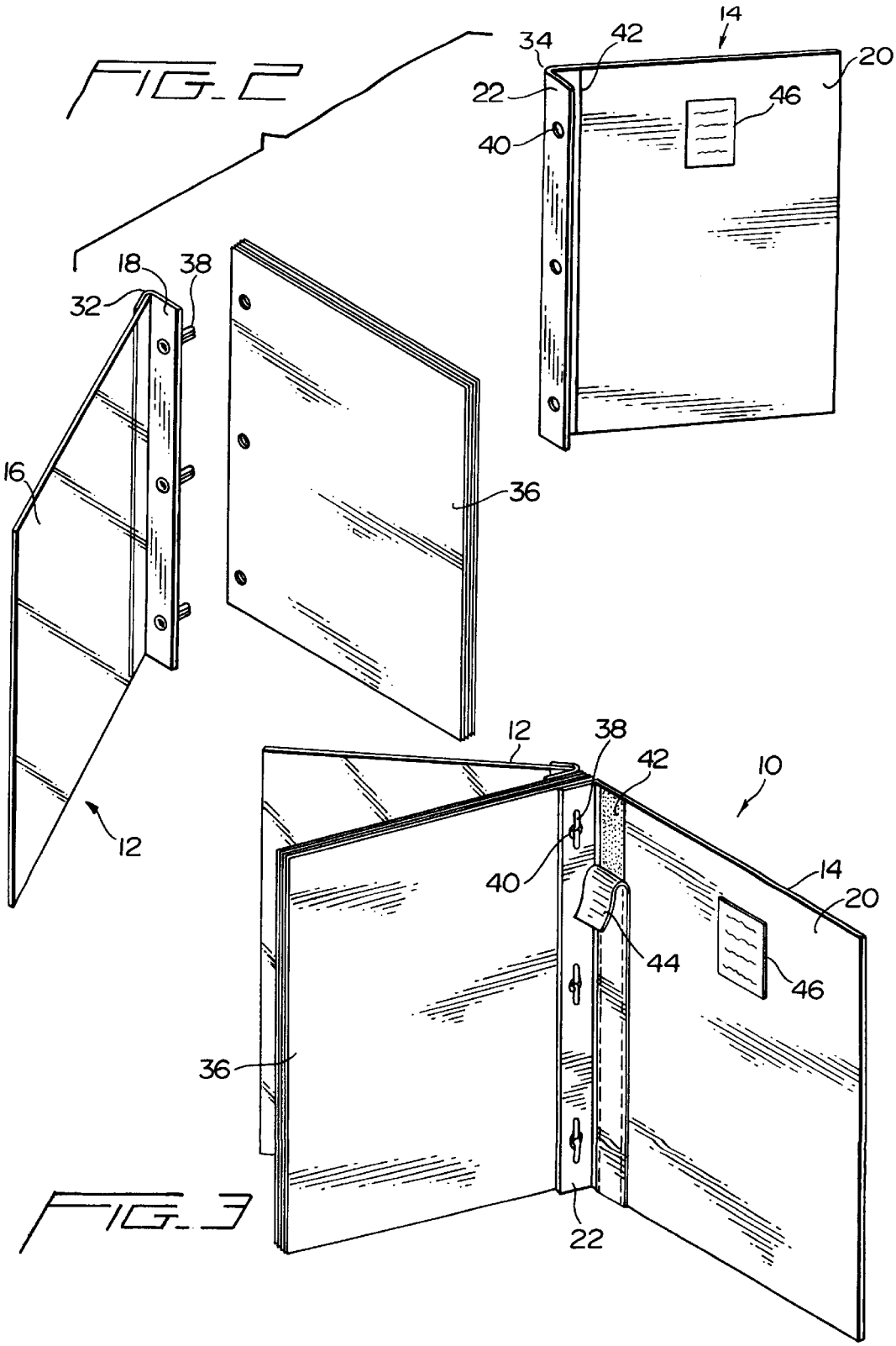
FIG. 2 is an exploded view of the present binder.
FIG. 3 is a perspective view of the binder partially assembled with the adhesive strip unattached.

Specifically, and with reference to FIGS. 2 and 3, the adhesive strip 42 is positioned along the interior surface **30*p* of the rear cover panel 20 adjacent the fold line 34 for the rear coupling flap 22. As such, the adhesive strip 42 is positioned to engage the interior surface 30*f* of the rear coupling flap 22 and the prongs 38 when the rear coupling flap 22 is folded down after attachment of the loose sheets 36 between the front and rear cover members 12, 14. Once the adhesive strip 42 securely engages the interior surface 30*f* of the rear coupling flap 22, ready access to the prongs 38 is prevented and it is impossible to remove the bound loose sheets 36 without destroying the fully assembled binder 10**.

With reference to FIGS. 2 to 5, a stack of loose sheets 36 is bound in the following manner. First, and as discussed above, the prongs 38 of the front coupling flap 18 are passed through apertures found in the loose sheets 36 to be bound. The exterior surface **24*f* of the front coupling flap 18 and the exterior surface 28*f* of the rear coupling flap 22 are then brought together with the loose sheets 36 therebetween, and the prongs 38 of the front coupling flap 18 are passed through the apertures 40 in the rear coupling flap 22. The prongs 38 are then bent over to securely coupled the front coupling flap 18 to the rear coupling flap 22. The release strip 44 is then removed to expose the adhesive strip 42. The binder 10 is then folded along the front fold line 32 and the rear fold line 34, bringing the adhesive strip 42 into contact with the interior surface 30*f* of the rear coupling flap 22**.

Attachment of the adhesive strip 42 to the interior surface **30*f* of the rear coupling flap 22 binds the interior surface 30*f* of the rear coupling flap 22 to the interior surface 30*p* of the rear cover panel 20. In this way, the prongs 38 are covered between the rear coupling flap 22 and the rear cover panel 20. As such, the bound loose sheets 36 may not be removed without destroying the fully assembled binder 10. This arrangement prevents individuals from removing loose sheets 36** from a bound transcript for copying, and ultimately ensures the integrity of the bound transcript, or other document.

With this in mind, the binder 10 is preferably provided with a notice 46 indicating that the binder 10 has been tampered with if the seal between the interior surface **30*f* of the rear coupling flap 22 and the interior surface 30*p* of the cover panel 20 is broken in anyway. For example, the notice 46** might state "This transcript cover has been sealed to protect the transcript's integrity. Breaking the seal will void the reporter's certification page. To purchase a copy of this transcript, please call the phone number listed on the bottom of the transcript page" . While such a notice is employed with the preferred embodiment of the present invention, the notice may be varied, or no notice may be included, without departing from the spirit of the present invention.

While the preferred embodiment has been shown and described, it will be understood that there is no intent to limit the invention by such disclosure, but rather, is intended to cover all modifications and alternate constructions falling within the spirit and scope of the invention as defined in the appended claims.

What is claimed is:

1. A copy safe binder comprising:

first and second cover members, each including a coupling flap, the second cover member including a cover panel adjacent to a first fold line and the first cover member including a coupling member extending from the coupling flap;

said coupling member of the first cover member selectively coupled to the coupling flap for permanently attaching loose sheets thereto; and wherein the cover panel of the second cover member includes an adhesive security strip secured to the cover panel adjacent to the fold line, the adhesive strip being positioned for attachment to the coupling flap after the binder and loose sheets are assembled, for preventing access to the coupling member thereby preventing the removal of the loose sheets from the binder without destroying a fully assembled binder.

2. The binder according to claim 1, wherein the cover member is a rear cover member, the coupling flap is a rear coupling flap and the cover panel is a rear cover panel.

3. The binder according to claim 2, further including a front cover member having a front coupling flap and a front cover panel linked by a second fold line, wherein the coupling member binds loose sheets between the front cover member and the rear cover member.

4. The binder according to claim 3, wherein the coupling member includes a first coupling member selectively coupled to the front coupling flap and a second coupling member selectively coupled to the rear coupling flap.

5. The binder according to claim 4, wherein the first coupling member is at least one prong extending from the front coupling member and the second coupling member is at least one aperture formed in the rear coupling flap for receipt of the at least one prong, the at least one prong and the at least one aperture cooperating to secure loose sheets between the front cover member and the rear cover member.

6. The birder according to claim 1, wherein the cover member is a rear cover member, the coupling flap is a rear coupling flap and the cover panel is a rear cover panel, and the binder further includes a front cover member having a front coupling flap and a front cover panel linked by a second fold line, wherein the coupling member binds loose sheets between the front cover member and the rear cover member.

7. The binder according to claim 6, wherein the coupling member includes a first coupling member selectively coupled to the front coupling flap and a second coupling member associated with the rear coupling flap, and the adhesive strip secures the rear coupling flap to the rear cover panel for preventing access to the first coupling member for the removal of loose sheets from the binder without destroying a fully assembled binder.

8. The binder according to claim 7, wherein the cover member, coupling flap and cover panel each includes an interior surface and an exterior surface, and the adhesive strip is attached to the interior surface of the cover panel.

9. The binder according to claim 7, wherein the first coupling member is at least one prong extending from the front coupling member and the second coupling member is at least one aperture formed in the rear coupling flap for receipt of the at least one prong, the at least one prong and the at least one aperture cooperating to secure loose sheets between the front cover member and the rear cover member.

10. The binder according to claim 1, wherein the cover member, coupling flap and cover panel each includes an interior surface and an exterior surface, and the adhesive strip is attached to the interior surface of the cover panel.

11. A method for permanently binding loose sheets within a binder including first and second cover members, each having a coupling flap wherein each coupling flap includes an exterior surface and an interior surface, the second cover member including a cover panel adjacent to a first fold line, and the first cover member including a coupling member selectively coupled to the coupling flap for attaching loose sheets thereto, and an adhesive security strip attached to the cover panel of the second cover member, comprising the following steps:

binding loose sheets within the binder; and bonding the cover panel to the coupling flap by securing the interior surface of the coupling flap to the interior surface of the adhesive security strip to prevent access to the coupling member, thereby preventing the removal of loose sheets from the binder without destroying a fully assembled binder.

12. The method according to claim 11, wherein the cover member is a rear cover member, the coupling flap is a rear coupling flap and the cover panel is a rear cover panel and the binder further includes a front cover member having a front coupling flap and a front cover panel linked by a second fold line; and the step of binding includes binding the loose sheets between the front and rear cover members.

13. The method according to claim 12, wherein the rear cover member, rear coupling flap and rear cover panel each include an interior surface and an exterior surface, and the security strip is attached to the interior surface of the rear cover panel; and the step of bonding includes securing the interior surface of the coupling flap to the interior surface of the rear cover panel.

14. The method according to claim 13, wherein the security strip is an adhesive strip.

15. The method according to claim 11, wherein the security strip is an adhesive strip adapted to for attachment to the coupling flap for preventing access to the coupling member for the removal of loose sheets from the binder without destroying a fully assembled binder.

* * * * *